United States Patent [19]

Scheidel et al.

[11] Patent Number: 4,473,912

[45] Date of Patent: Oct. 2, 1984

[54] PATIENT SUPPORTING AND TRANSPORTING BACKBOARD AND ACCESSORIES THEREFOR

[76] Inventors: Edward J. Scheidel, 4885 Cannonsburg Rd., Belmont, Mich. 49306; Lawrence K. Buckenmeyer, 3121 Hayward Dr., Grand Rapids, Mich. 49506

[21] Appl. No.: 323,900

[22] Filed: Nov. 23, 1981

[51] Int. Cl.[3] ..... A61G 1/00

[52] U.S. Cl. ..... 5/82 R; 128/133; 428/192

[58] Field of Search ..... 5/82 R, 81 R, 424; 52/823, 822; 428/192; 108/901, 902; 224/157, 158; 128/133, 134

[56] References Cited

U.S. PATENT DOCUMENTS

D. 232,198 7/1974 Thompson.
539,690 5/1895 Lasher, Jr.
677,673 7/1901 Mahan.
941,072 11/1909 Huber.
1,205,649 11/1916 Miller.
1,239,522 9/1917 LaRock.
1,567,799 12/1925 Galloway.
1,689,721 10/1928 Harris.
1,761,233 6/1930 Roe.
1,836,911 12/1931 Fitch.
1,936,113 11/1933 Jelliffe.
2,015,391 9/1935 Anderson.
2,033,779 3/1936 Monk.
2,149,090 2/1939 Hills.
2,361,789 10/1944 Nicholas.
2,395,468 2/1946 Eames.
2,586,986 2/1952 Orrison.
2,607,103 2/1952 Davidson.
2,674,996 4/1954 Stowell et al.
2,675,564 4/1954 Hughes.
2,677,159 5/1954 Berg.
2,679,842 6/1954 Brill ..... 128/134
2,743,974 5/1956 Black.
2,773,726 12/1956 Johansson et al. ..... 52/823
2,831,482 4/1958 Cobb.
2,833,003 5/1958 Bourne et al. ..... 52/823
2,957,737 10/1960 Irwin et al.
2,973,889 3/1961 Phillips ..... 5/82 R
3,049,729 8/1962 Broyles ..... 5/200 R
3,063,447 11/1962 Kirsten.
3,133,295 5/1964 Klingensmith.
3,221,735 12/1965 Goodman et al.
3,247,529 4/1966 Benton.
3,264,659 8/1966 Magni et al.
3,327,893 6/1967 Graves.
3,348,245 10/1967 Shindler.
3,410,621 11/1968 Schreyer.
3,414,914 12/1968 Gramins.
3,449,776 6/1969 Brock.
3,469,268 9/1969 Phillips.
3,566,422 3/1971 Klippel.
3,574,397 4/1971 Norriss.
3,574,871 4/1971 Greene.
3,578,383 5/1971 Earl.
3,608,964 9/1971 Earl.
3,609,778 10/1971 Ziener.
3,611,454 10/1971 Klipper.
3,648,305 3/972 Ersek.
3,656,193 4/1972 Schnieder et al.
3,672,364 6/1972 Rankin.
3,675,255 7/1972 Johansson.
3,699,593 10/1972 Oetiker.
3,707,734 2/1973 Matthews.
3,732,863 5/1973 Prolo.
3,775,782 12/1973 Rice et al.
3,783,863 1/1974 Kliever.
3,811,433 5/1974 Brachet.
3,840,221 10/1974 Hogan.
3,897,777 8/1975 Morrison.
3,957,262 5/1976 McReynolds.
4,017,118 4/1977 Cawley.
4,024,861 5/1977 Vincent.
4,034,748 7/1977 Winner.
4,067,565 1/1978 Daniels.
4,099,523 7/1978 Lowrey.
4,109,887 8/1978 Wakeland, Jr.
4,114,612 9/1978 Benjamin.
4,122,587 10/1978 Weiss et al. ..... 128/134.
4,124,908 11/1978 Burns et al.
4,128,272 12/1978 Boyle.
4,143,654 3/1979 Sherman.
4,153,323 5/1979 Giacin.
4,151,842 5/1979 Miller.
4,182,322 1/1980 Miller.
4,183,110 1/1980 Kidd et al.
4,194,732 3/1980 Liebman.
4,220,147 9/1980 Allen, III.
4,226,231 10/1980 Andersen.

FOREIGN PATENT DOCUMENTS 116901 5/1943 Australia.
228079 11/1962 Austria.
1298352 6/1962 France.
92208 6/1958 Norway.
809230 2/1959 United Kingdom.
926938 5/1963 United Kingdom.
563976 of 0000 U.S.S.R..

OTHER PUBLICATIONS

Dyna Med., Manufacturers of Emergency Care Products, Catalog #1001 for 1980, pp. 76–79.
Indiana Mills & Manufacturing, Inc. of Carmel, Indiana, 1980 Leaflet of Instructions for Strap-Aid Dispenser.

*Primary Examiner*—Alexander Grosz

[57] ABSTRACT

A patient supporting and transporting backboard assembly formed from two cooperating, substantially rigid, lightweight panels which are corrosive, splinter, rot and stain resistant, can be sterilized for use in hospital environments, and allow patient x-rays without transferring the patient to another support. The panels are preferably formed from resinous plastic material such as polycarbonate and include integral, stabilizing ribs or channels and a peripheral edge structure providing a carrying handhold. Tie-down straps having resilient clips received on the edge structure can be positioned as desired along the length of the backboard. Supplemental carrying handles and head restraint assemblies for immobilizing a patient's head and/or applying cervical traction are also provided for attachment to the backboard.

32 Claims, 18 Drawing Figures

PATIENT SUPPORTING AND TRANSPORTING BACKBOARD AND ACCESSORIES THEREFOR

BACKGROUND OF THE INVENTION

This invention relates to backboards for supporting, carrying and transporting patients for emergency medical treatment and, more particularly, to an improved, lightweight, durable, degradation resistant backboard which enables transportation of a patient while minimizing risk of further injury.

Emergency medical treatment often requires the transportation of a patient from an accident site to a hospital or other location where more complete and extensive medical treatment can be performed. The common method for such transportation is on a stretcher or rigid backboard to which the patient is secured using straps or the like. Such backboards are common place in ambulances, emergency medical vehicles, swimming pools, athletic arenas and the like. Such backboards are often improperly stored, mishandled, and/or generally given insufficient care and maintenance. In the past, several different varieties of backboards have been used including solid or laminated wood boards, glass fiber reinforced resinous plastic boards, aluminum or other metallic boards, or composition or pressed boards. Each of these varieties has its own problems and drawbacks.

In the case of backboards made from solid or laminated wood, such as plywood, since such boards are often subjected to the weather by being stored outside at swimming pools, ski areas or the like, they are subject to splintering, rot and other degradation from the elements. Such boards also tend to absorb and/or retain fluids or other foreign matter, and can cause infection given the circumstances in which they are used. Further, it is not uncommon that wooden boards, because of deterioration, break during use causing further aggrevation to the injuries of the transported patient or even injury to the rescuer. Wooden boards have also suffered from a limitation in the number of handholds included thereon and have thus been less than adequate in allowing carrying in many situations.

Glass fiber reinforced resinous plastic backboards have also been used but such boards have also been subject to splintering, chipping and/or the loss of glass fiber particles which can cause a rash on the skin of the patient being transported. Such rash has, in the past, led to an improper diagnosis of the injuries to the patient. Further, glass fiber reinforced resinous plastic boards tend to absorb moisture and thus can freeze when used in cold environments and/or cause infection of the patient being carried much like wooden boards.

Metallic boards, such as those made from aluminum, have also been tried but, because of their temperature conduction characteristics, have caused discomfort in use in cold or extremely warm climates. Such metallic boards also tend to freeze more readily and have little or no buoyancy which makes them unsuitable for use in transferring patients having back or spinal injuries from swimming pools or lakes. In addition, many of the prior known metallic backboards required the use of numerous parts which could disassemble in use and cause premature failure of the board.

A fourth type of board is that made from composition or particle board. These tend to be very heavy, difficult to use, and also suffer from many of the same drawbacks as the wooden boards.

In view of the above problems, a need was recognized for an improved backboard which could overcome the above problems and provide a light-weight, easy to use, strong, durable and degradation resistant device suitable for all types of situations encountered in emergency medical treatment.

SUMMARY OF THE INVENTION

Accordingly, the present invention provides a patient supporting and transporting backboard which overcomes the above problems by providing a pair of cooperating, substantially rigid panels, one panel fitted over top the other and adapted to carry a patient, the other panel being fitted under the top panel and engaging, supporting and being secured to the top panel to rigidify and stabilize the same. Preferably, each panel is molded from a resinous plastic material such as polycarbonate or modified phenylene oxide and includes a downturned, peripheral flange for securing the panels together and forming a peripheral handhold around the entire backboard. The bottom panel peripheral flange is nested within and secured to the top panel peripheral flange. The panels are secured together to form a rigid backboard unit.

Preferably, the panels forming the present backboard also include a series of ribs in at least one of the panels for reenforcing, stabilizing and rigidifying the other panel, as well as an edge strip extending along the combining panel flanges for attaching the top panel flange to the bottom panel flange. Together, the flanges and edge strip are adapted to receive and removeably attach securing clip members on various backboard accessories including tie-down straps, supplemental carrying handles, and/or head restraints at numerous and varied positions as desired on the board.

In one preferred form, the edge strip extending along the peripheral flanges is an extruded, resinous plastic, contoured strip fitted over and secured to the flanges. In another form, the flanges are themselves contoured or molded into a bulbous shape and secured together using an edge strip having opposing slots therein for receiving the aligned edges of the flanges. In either form, a continuous notch or recess on the inside surface of at least one of the flange or edge strip provides a securing area for further securing the clip means on the accessories mentioned above.

The accessories themselves may include a head restraint assembly for substantially immobilizing the head of a patient and/or applying cervical traction when secured and arranged on the backboard, a plurality of adjustable tie-down straps which may be clipped anywhere along the periphery of the board, as well as supplemental carrying handles including securing clips enabling them to be clipped on the periphery of the board at desired locations. In addition, the backboard may include handhold apertures which allow use of conventional straps and/or provide additional handholds for rescurers using the board.

When used in the above forms, the present invention provides a lightweight, strong, durable, corrosive resistant backboard which will stand up to rough handling, storage in and exposure to the elements without deterioration. The backboard assembly resists rot, splintering, chipping, the shedding of particles and the absorption or retention of fluids or foreign matter, thus being stain and infection resistant. The board may be sterilized for use in hospital environments, and allows x-rays to be taken of a patient carried on the board without further transfer of the patient to another support. Since the backboard assembly is at least partially hollow and the preferred material has its own natural buoyancy, the backboard is especially useful for emergency medical treatment of swimming injuries. Further, the board resists freezing, provides a unitary structure which is unlikely to disassemble, and is resistant to extreme heat for short periods of time making it especially useful for rescues from fires or burning buildings. When formed from the preferred polycarbonate material, even if the board is burned, it is reduced to carbon dioxide and water which are not toxic to humans. In addition, the present backboard is easier to carry by a larger number of rescuers than are prior known boards due to the provision of the handhold around the entire perimeter thereof, in addition to allowing use of extra carrying handles. The present backboard encourages the use of tie-down straps for the immobilization of the transported patient and provides a unique assembly for immobilization of the head and neck of an injured patient which can also be utilized to provide cervical traction during transportation to a hospital.

These and other objects, advantages, purposes and features of the invention will become more apparent from a study of the following description taken in conjunction with the drawings.

DESCRIPTION OF THE PREFERRED EMBODIMENTS

Figure 1:
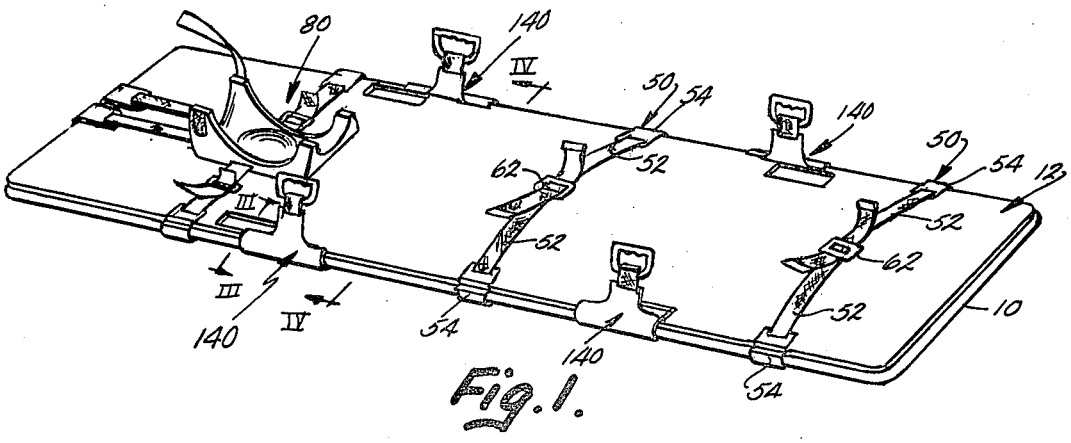
FIG. 1 is a perspective view of the backboard assembly of the present invention illustrating the tie-down strap, supplemental carrying handle and head restraint accessories secured thereto.
Figure 2:
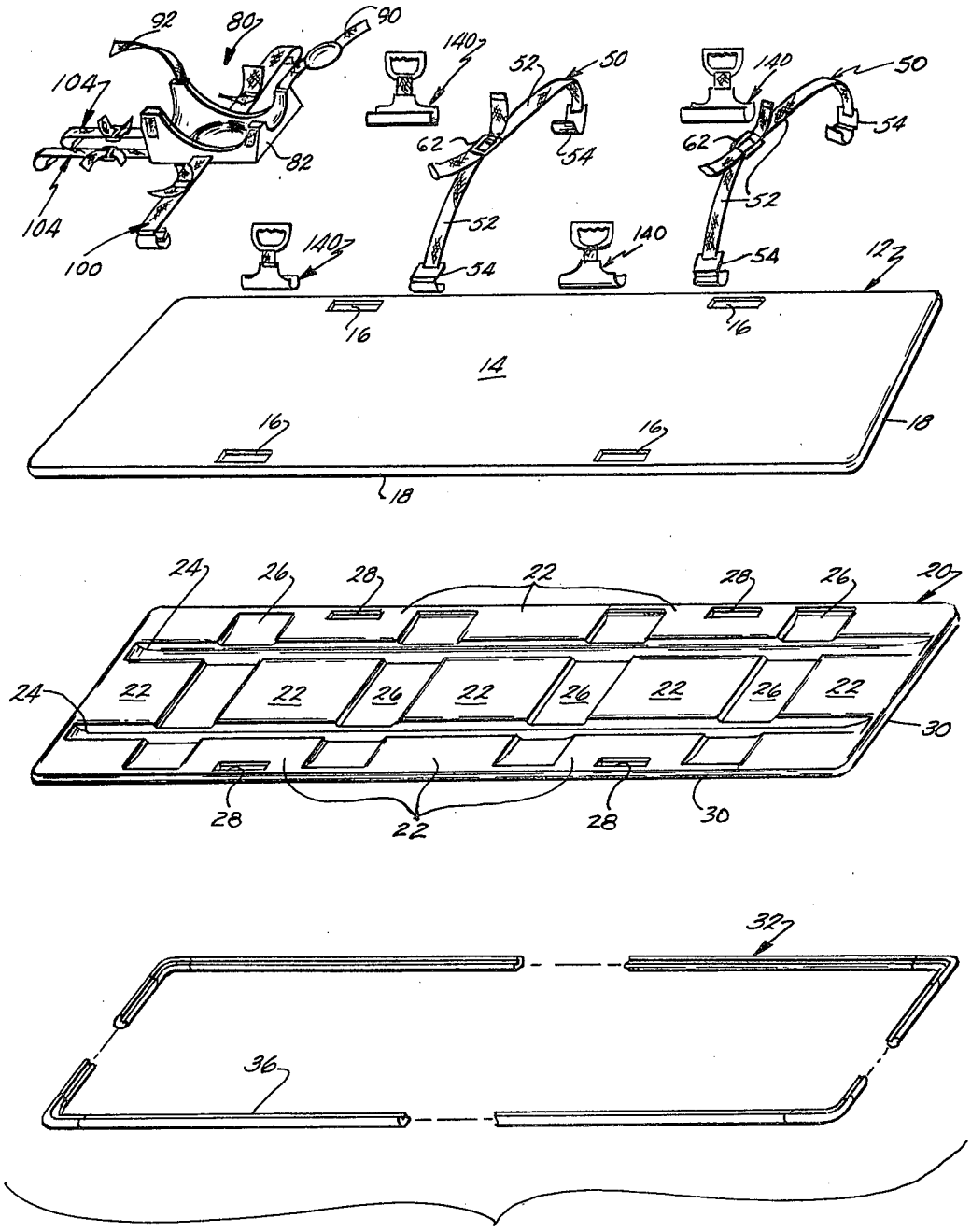
FIG. 2 is an exploded, perspective view of the various panel, edge strip and accessory portions of the backboard of the present invention.

Referring now to the drawings in greater detail, FIGS. 1 and 2 illustrate a first embodiment 10 of the patient supporting and transporting backboard of the present invention. Backboard 10 is especially designed for use in emergency medical treatment situations such as the transfer of automobile accident victims, swimming injury victims, fire victims and the like. It provides a rigid, stable, substantially planar transporting surface to which a patient may be secured to prevent further injury through the use of tie-down straps 50 and one of head restraint assemblies 80 of 120. It may be easily carried by means of supplemental carrying handles 140.

With specific reference to FIGS. 1–4, backboard assembly 10 includes two generally rectangular, lightweight, substantially rigid panels preferably molded from a resinous plastic material such as polycarbonate or modified phenylene oxide. Both panels are approximately 18"×72" in a preferred form. The top or upper panel 12 includes a substantially planar, patient carrying area 14, a series of laterally aligned, rectangular handhold apertures 16 adjacent the lateral edges thereof, and an outwardly flared, downturned flange 18 extending continuously around the entire periphery of the panel. The lower or bottom panel 20 also has a generally rectangular shape but is slightly smaller than the top panel 12 so as to nest within top panel 12 therein when the panels are fitted together.

Figure 4:
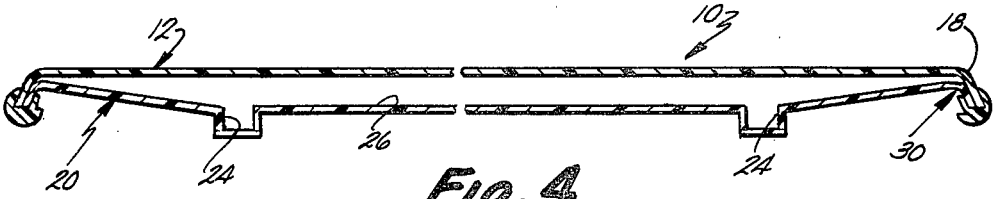
FIG. 4 is a broken, sectional view of the first form of the backboard assembly taken along line IV—IV of FIG. 1 and illustrating the interior structure thereof.
Figure 3:
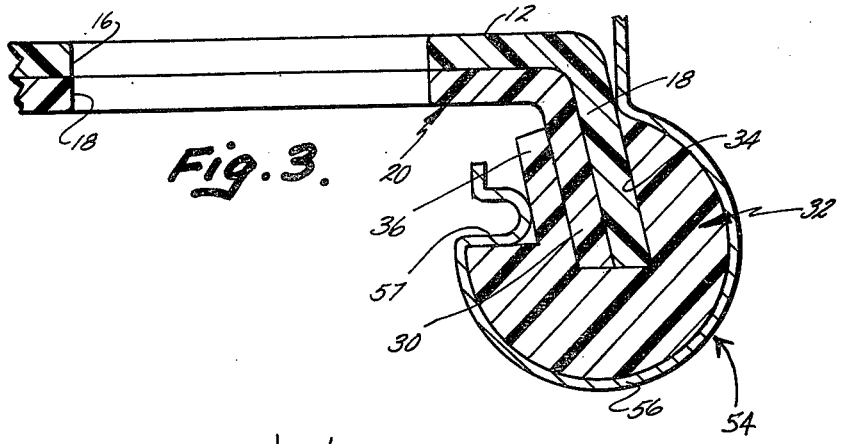
FIG. 3 is a fragmentary, sectional view taken along line III—III of FIG. 1 illustrating the edge structure of a first embodiment of the backboard assembly, the edge structure receiving the resilient body of an supplemental carrying handle secured therearound.

As shown in FIG. 2, bottom panel 20 includes a plurality of substantially planar areas 22 separated by upwardly and inwardly opening, integral, stiffening and stabilizing channels 24 extending parallel to one another along the longitudinal length of the backboard, as well as a series of equally spaced, upwardly and inwardly opening cross channels 26 which intersect the longitudinally extending channels 24, extend from side to side, and provide tranverse stability for the bottom panel. In addition, bottom panel 20 includes rectangular handhold apertures 28 positioned to be in alignment with handhold aperture 16 when panels 12 and 20 are fitted together as shown in FIG. 3. As shown in FIG. 4, longitudinal channels 24 are deeper than cross channels 26 and are substantially coterminous and coplanar so as to provide spaced supports for the backboard assembly 10 when placed on the ground or other support surface. Panel 20 further includes a peripheral edge flange 30 which is outwardly and downwardly flared and adapted to nest within and extend substantially parallel to edge flange 18 on panel 12 as shown in FIG. 3.

As is best illustrated in FIG. 3, panels 12 and 20 are designed to fit and nest together, one under and within the other, and to be secured together by an appropriate adhesive compatable with the resinous plastic material from which the panels are formed such as SUPERBONDER (Trademark), a cyanoacrylate adhesive manufactured by Loctite Corporation, Newington, Conn. The adhesive is applied both to the nesting flanges 18, 30 and to planar areas 22 which contact and support the underside of planar area 14 on the upper panel. In addition, edge flanges 18, 30 are substantially coterminous and adapted to receive an edge strip 32 to help secure them together and maintain the backboard 10 as an integral unit. The hollow areas within backboard 10 provide buoyancy allowing use of the board in pools or lakes.

As shown in FIGS. 2–4 edge strip 32 is a substantially rigid, generally cylindrical extrusion of synthetic, resinous plastic material such as nylon, polycarbonate or polyethylene. Edge strip 32 includes a generally cylindrical body and extends around the entire periphery of the backboard. It is fitted over the combined edge flanges 18, 30 after initial assembly of panels 12, 20 by means of a slot 34 formed at an angle therein to receive the downwardly and outwardly flared combined flanges. Suitable adhesive is also used in slot 34 to secure strip 32 to the combined flanges. Strip 32 also includes a continuous, interior, V-shaped notch 36 which receives and helps secure the securing clips from the tie-down straps, supplemental carrying handles and head restraint straps in a manner more fully described hereinafter.

As shown in FIG. 2, edge extrusion 32 may be formed in an overall rectangular shape. Alternately, the lateral side and end portions may be formed in rectilinear lengths with the four corners provided in sections and fitted separately to the corners of the combined flanges. As shown in FIG. 3, the extruded edge strip 32, together with the flanges 18, 30, when assembled as set forth above, form an edge structure which provides a convenient and secure handhold for carrying the entire backboard from any position around the periphery of the backboard. A number of persons or rescuers can thus grab the flange-strip structure simultaneously. In addition, the edge structure provides an appropriate securement for the securing clips from the accessories as will be described below.

Figure 15:
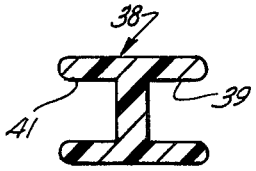
FIG. 15 is an enlarged view of the extruded edge strip used to secure the flanges of the second form of the backboard assembly shown in FIGS. 13 and 14.
Figure 13:
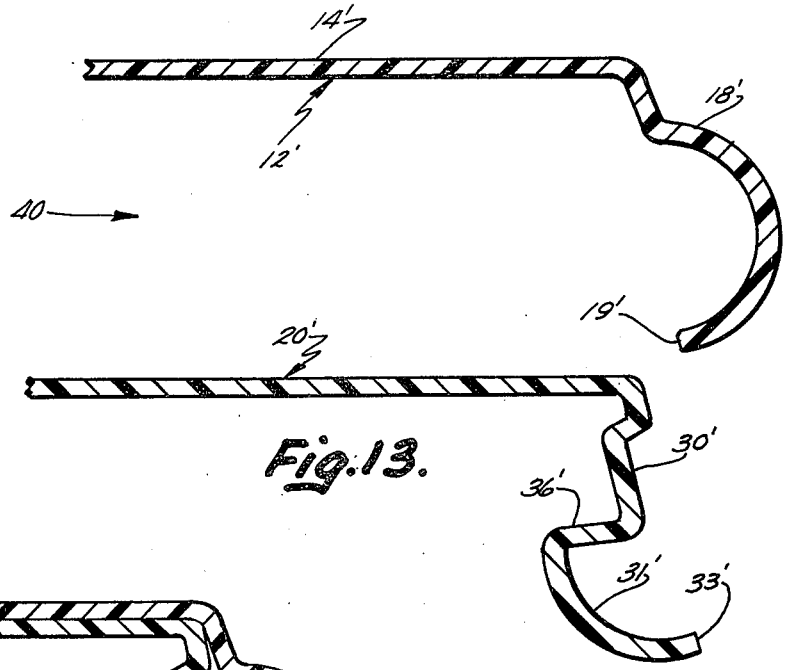
FIG. 13 is a fragmentary, exploded, sectional view of a second form of the backboard assembly illustrating the contoured flange portions thereon.
Figure 14:
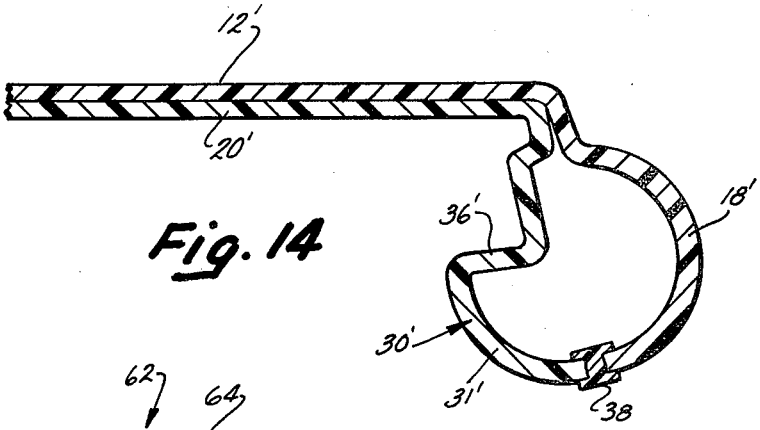
FIG. 14 is a fragmentary, sectional, assembled view of the backboard assembly embodiment shown in FIG. 13.
Figure 16:
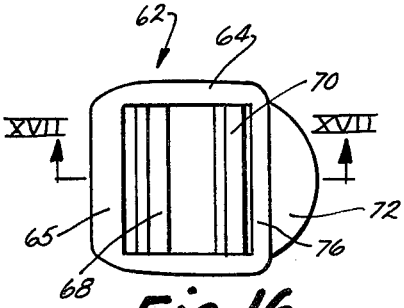
FIG. 16 is a plan view of a suitable adjusting buckle used in the tie-down straps and securing straps for the head restraints.
Figure 17:
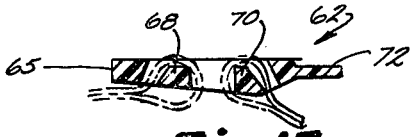
FIG. 17 is a sectional view of the adjusting buckle taken along line XVII—XVII of FIG. 16.
Figure 18:
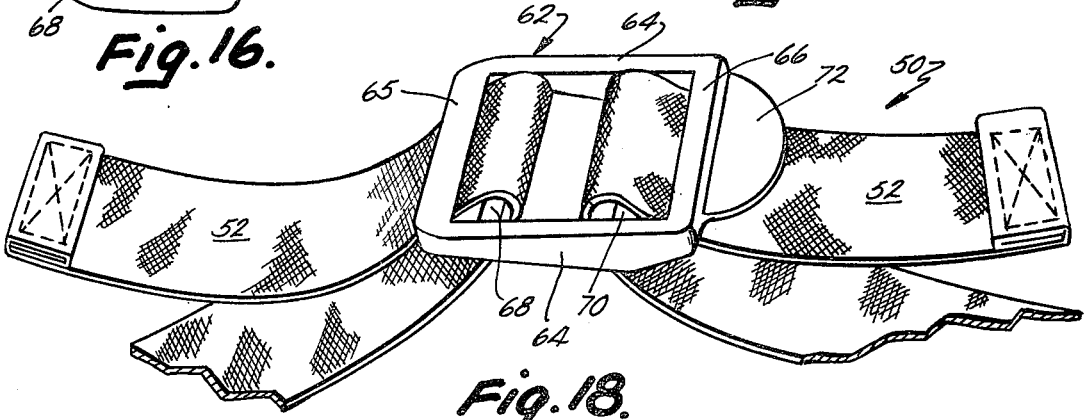
FIG. 18 is a perspective view of the adjusting buckle shown in FIGS. 16 and 17 secured within one of the tie-down straps used with the backboard assembly of the present invention.

An alternate form 40 of the patient transporting backboard assembly is shown in FIGS. 13–15. In this form, top panel 12′ includes a substantially planar patient supporting area 14′ and a contoured, outwardly curved, downwardly and outwardly flared flange 18′. The outwardly curved section of flange 18′ has the sectional shape of a semi-circle. Likewise, bottom panel 20′ includes planar area and integral rib channels in a manner similar to that described above for panel 20, but includes an outwardly and downwardly flared contoured flange 30′ having an area 31′ in the shape of a quarter circle and indented, continuous, V-shaped notch 36′ in the same, inner location as notch 36 in embodiment 10. Preferably, panels 12′ and 20′, like panels 12 and 20, are molded from polycarbonate sheet material or modified phenylene oxide sheet into the shapes shown in FIG. 13.

As shown in FIGS. 14 and 15, panels 12′ and 20′ are combined and secured in much the same manner as are panels 12 and 20 with panel 20′ being nested within upper panel 12′. However, end edges 19′ and 33′ of flanges 18′, 36′ are aligned when the panels are nested together. Edges 19′, 33′ are secured together and sealed off by an extruded edge strip 38 which, as shown in FIG. 15, includes aligned, opposing slots 39, 41 which receive flange end edges 19′ 33′ respectively. Extruded edge strip 38, which has the cross sectional shape of an H, may be formed from polycarbonate, phenylene oxide or another resinous plastic material such as nylon. Preferably, end edges 19′, 33′ are adhered within slots 39, 41 by a suitable adhesive such as SUPERBONDER (Trademark), a cyanoacrylate adhesive manufactured by Loctite Corporation, Newington, Conn. Strip 38 thus seals off the interior of the combined flanges forming a hollow, bulbous portion around the entire periphery of the backboard. This hollow bulbous portion, together with the spaced interior of the center sections of the combined panels 12′, 20′ provides a buoyancy for the backboard 40 making it especially useful in situations requiring the transfer of victims injured in swimming accidents since the backboard will float. Backboard 40 may include handhold apertures such as those shown at 16, 28 in embodiment 10 of the backboard in which case suitable adhesive is applied around the perimeter of that aperture to seal off and prevent the entry of water into the interior thus preserving the buoyant nature of the backboard 40.

In either of backboard assembly embodiments 10 or 40, the lower panel 20, 20′ rigidifies and stabilizes the upper panel 12, 12′. Together with one of edge strips 32, 38, the entire composite backboard assembly provides a unitary structure which is light in weight and easily carried using the peripheral handhold edge structure, the additional handhold apertures 16, 28, or the supplemental carrying handles 140 described hereinafter.

Referring to FIGS. 1, 2, 12 and 16–18, either of the backboard embodiments 10 or 40 is designed for use with a patient tie-down and securing strap 50. Each tie-down strap includes two lengths of strong, nonstretchable, fabric or cloth webbing of the type commonly used in automobile seatbelts. Each webbing length 52 is combined with a securing clip 54 (FIG. 12) for attachment of the tie-down strap to the peripheral handhold flange structure on the backboard. Securing clip 54 includes a resilient body portion 56 and an extending, connection flange 58 offset from body 56 by shoulder 55 and having a rectangular aperture 60 adjacent the end of flange 58. Shoulder 55 allows flange 58 to extend above planar surface 14 of panel 12 when secured to the edge structure. One end of webbing length 52 is inserted through aperture 60 and sewn to itself to prevent removal from the securing clip. The remaining free ends of webbing length 52 are led toward one another and combined with a plastic or other securing buckle 62 (FIGS. 16–18) to enable adjustment of the length of the tie-down strap to adequately secure a patient on the backboard.

Buckle 62, which is but one suitable adjustment device useable with webbing lengths 52, includes a square or rectangular outer peripheral wall 64 having opposing end portions 65, 66. Spaced inwardly from end walls 65, 66, and from one another, are a pair of cross-ribs 68, 70 extending between side wall portions 64 and over which webbing 52 is looped upon itself as shown in phantom in FIG. 17. In this regard, the end of webbing 52 is passed upwardly through the space at the center of buckle 62 between ribs 68, 70, passed over one of the ribs 68 or 70 and returned downwardly through the space between that one rib 68 or 70 and the adjacent end wall 65 or 66 and doubled upon itself as shown in FIGS.

17 and 18. Thereafter, the free end of the webbing 52 is rolled and sewn to prevent withdrawal through the spaces in the buckle. After insertion and assembly of both webbing lengths 52 in buckle 62, the free ends of the webbing may be pulled away from one another to shorten the length of the overall tie-down strap. The edges of the buckle structure engaging the webbing to resist its withdrawal when tigthened in this manner. When loosening is desired, a thumb flange 72, formed integrally with end wall 66, may be pivoted upwardly to loosen and lengthen the webbing and release the patient from the backboard. Buckle 62 may be obtained from Indiana Mills and Manufacturing, Inc. of Carmel, Ind.

With reference again to FIGS. 3 and 12, the structure and operation of the securing clip 54 will be more fully understood. In addition to connection flange 58 mentioned above, resilient body portion 56 of clip 54 is generally cylindrically shaped and has an inside diameter slightly larger than the outside diameter of extruded cylindrical strip 32 or the exterior surface of combined, contoured flange portions 18', 30'. Adjacent the free end 59 of the body portion of clip 56 is a U-shaped, rounded, radially inwardly projecting protrusion 57 which is designed to engage notch 36 or 36' in the edge flange structure to prevent rotation of the clip about the flange structure except when removal is desired. Preferably, securing clip 54 is formed from tempered sheet aluminum or stainless steel sheet material and stamped and/or rolled into the shape shown in FIGS. 3 and 12.

To insert the securing clip over the combined flange and edge strip structure at the edges of the backboard, it is merely necessary to grasp the upwardly extending free end 59 of body portion 56 adjacent inward protrusions 57 and flex it outwardly away from the remainder of the body portion while passing the body portion of the clip over the combined flange and edge strip structure. Upon release, inward protrusion 57 engages notch 36 or 36' and seats the clip properly in place and prevents its removal. As will be understood, since the entire length of the flange and edge strip structure has this external, cylindrical shape, securing clips 54 may be attached at virtually any place along its length except for the corners of the backboard.

Figure 5:
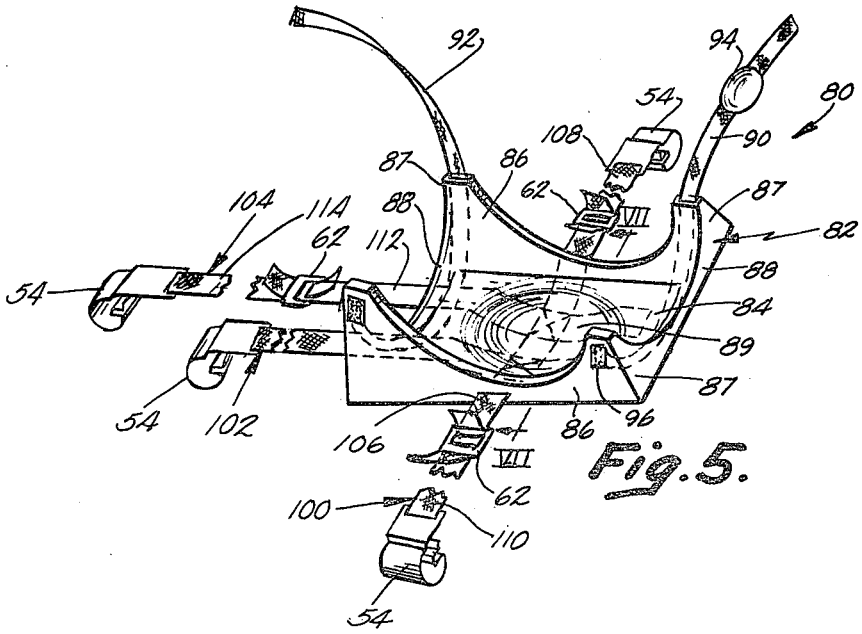
FIG. 5 is a perspective view of a first form of the head restraint assembly with portions of its securing straps broken away.
Figure 6:
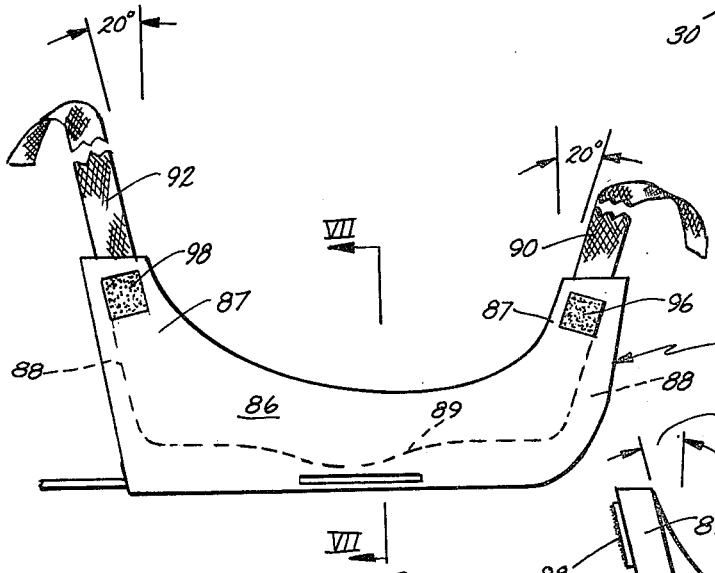
FIG. 6 is a side elevation of the head restraint shown in FIG. 5.
Figure 7:
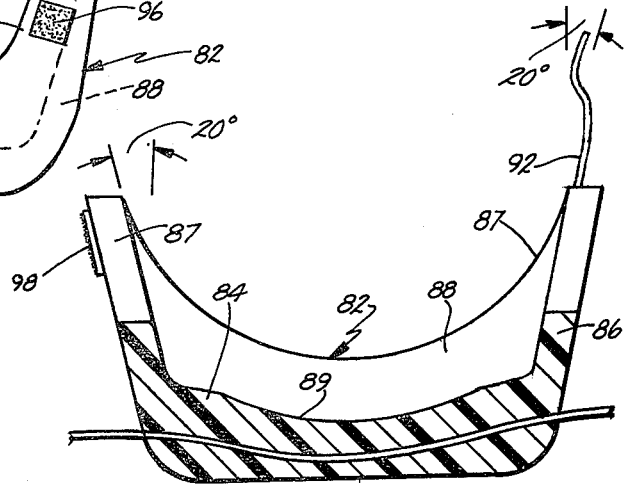
FIG. 7 is a sectional view of the head restraint taken along line VII—VII of FIG. 6.
Figure 12:
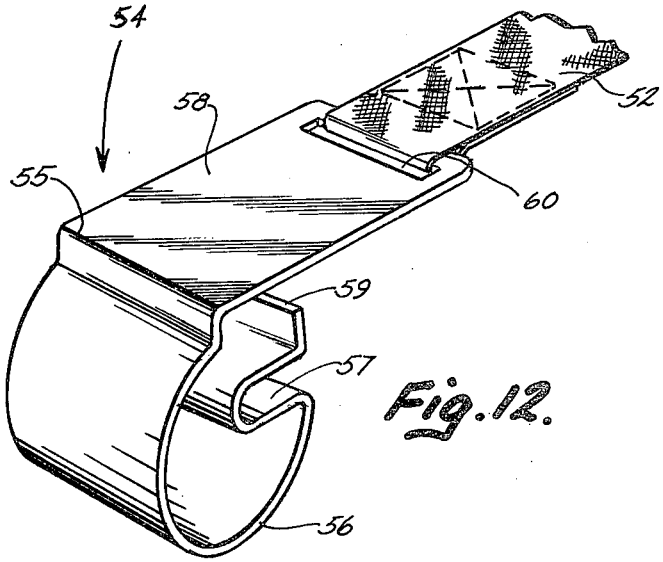
FIG. 12 is a fragmentary, perspective view of one of the securing clips and attached webbing end of a tie-down strap used with the backboard assembly.

Referring now to FIGS. 5–7, a first embodiment 80 of a suitable head restraint for use with backboard assembly 10 or 40 is shown. Head restraint 80 is designed for attachment to the top surface of backboard 10 or 40, adjacent one end thereof, so as to immobilize the head and neck of an injured patient carried on the backboard. The head restraint includes a contoured head receptacle 82 preferably formed from elastomeric urethane foam which is preferably injection molded in a suitable mold and heated to form its own skin which resists soiling, staining and fluid absorption. Head receptacle 82 includes a base 84 and upwardly and outwardly extending side and end portions 86, 88 respectively which define a cranial depression receiving the back of the head of a patient being carried on the backboard. In order to properly locate the patient's head properly within the cranial depression, an additional shallow spherical depression 89 may be formed in the center of base 84 as shown in FIGS. 5–7.

At the corners of the head restraint 82, side and end walls 86, 88 curve upwardly to form four securing area 89 from which protrude securing straps 90, 92. Straps 90, 92 are designed to fit over and engage the chin and forehead areas of the patient's head. Strap 90 includes a chin cup 94 centered therein and extends downwardly through and is embedded in the molded foam of the head restraint 82 through the base 84 to the opposite securing area. Similarly, forehead strap 92 extends downwardly through the molded foam of the head restraint to the opposite securing area to thus securely embed the straps 90, 92 in place and prevent their removal. Each of the straps 90, 92 includes a strip of Velcro (trademark) material sewn thereto which engages a length of Velcro material secured by an appropriate adhesive or the like to the exterior of the opposite securing area as shown in FIGS. 5 and 6. Hence, when the back of a patient's head is resting in the spherical depression 89, strap 90 is placed over the chin of the patient with chin cup 94 engaging the patient's chin and the free end of the strap engaging Velcro strip 96. Similarly, forehead strap 92 is placed over the forehead of the victim and snugged around the skull and attached to Velcro strip 98. When both straps are secured in this fashion, the head is held immobile within the head restraint. As will be seen from FIG.'S 6 and 7, the securing areas from which the securing straps 90, 92 protrude converge downwardly and inwardly preferably at an angle of approximately 20 degrees (FIG. 6) so as to apply restraining force to the chin and forehead areas urging the patient's head into the center of the cranial depression formed by the head restraint.

In order to position the head restraint 82 on the planar surface 14 of top panel 12 or 12' of the backboard, a series of positioning and securing straps 100, 102 and 104 extend perpendicularly to one another as shown in FIGS. 1, 2 and 5. Positioning strap 100 includes a length 106 of nylon or other fabric webbing similar to that used for tie-down straps 50. Webbing length 106 passes beneath the center of spherical depression 89 and extends laterally out of either side of the base 84 of head restraint 82. Separate additional lengths 108, 110 of fabric webbing are coupled to buckles 62 along with the free ends of webbing length 106 to provide adjustment for the length of the positioning strap 100 on either side of the head restraint 82. The remaining outside free ends of lengths 108, 110 of webbing are secured to securing clips 54 for attachment to the combined flange-edge strip structure along the edge of the backboard in the manner described above in connection with tie-down straps 50. Positioning strap 100 thus allows movement of the head restraint 82 from side to side on the backboard to accommodate the lateral position of the patient's head.

In order to provide longitudinal positioning of the head restraint, and also to apply traction force to the cervical vertebrae of the patient carried on the backboard when desired, a pair of positioning and traction straps 102, 104 extend perpendicularly to the direction of extent of strap 100. Each of straps 102, 104 includes a length 112 of nylon or other fabric webbing which extends through base 84 under the spherical depression 89, intersects and is sewn to webbing 106 of strap 100 and is firmly embedded within the molded head restraint. The free end of each of strap 112 is secured to a buckle 62 along with the free one end of another length of webbing 114 having its free end attached to a securing clip 54 in the same manner as described above for straps 100 and 50. Clips 54 on positioning straps 102, 104 are fitted around the combined flange-edge strip structure at the end of the backboard adjacent which the head restraint is positioned. Straps 112, 114 are used to adjust the position of the head restraint longitudinally along the backboard and/or to apply traction to the patient's neck once his head is positioned in the head restraint and straps 90, 92 are secured. In such situation, the patient must first be secured atop the backboard using tie-down straps 50 in order to apply the proper traction force.

Figure 8:
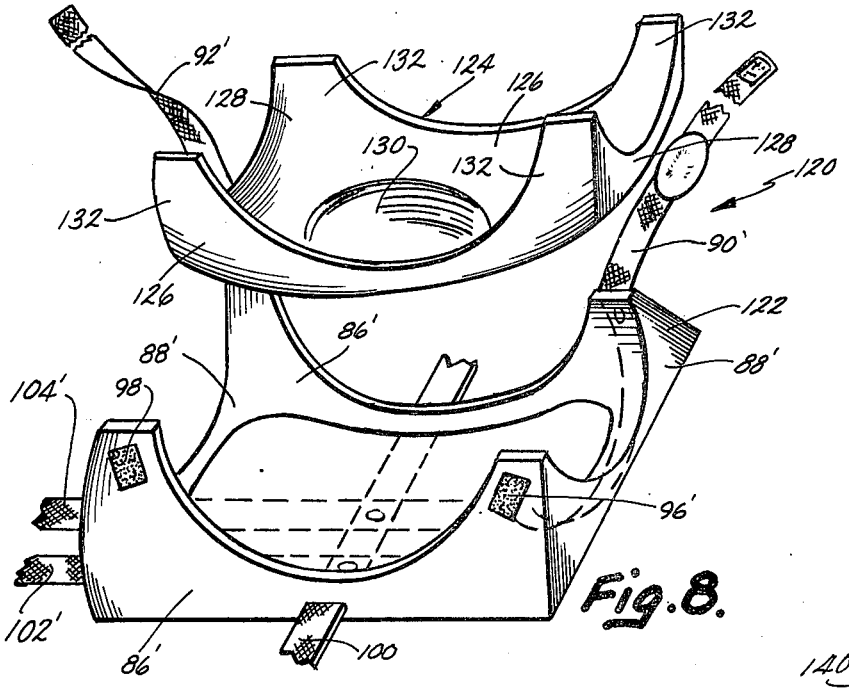
FIG. 8 is a fragmentary, perspective view of a second form of the head restraint including a substantially rigid base and a resilient foam liner received therein.
Figure 9:
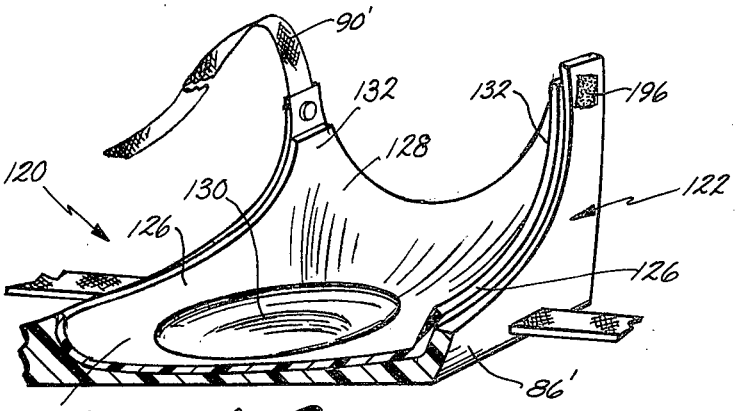
FIG. 9 is a fragmentary, sectional, perspective view of the head restraint shown in FIG. 8.

A second embodiment 120 of the head restraint is shown in FIGS. 8 and 9. In this form, head restraint 120 includes a two-piece head receptacle including a substantially rigid base portion 122 molded from high density polyethylene and including base 84', upstanding side and end walls 86', 88', embedded chin and forehead securing straps 90', 92', longitudinal and transverse positioning and securing straps 100', 102' and 104', and Velcro securing strips 96', 98' all similar to those included in embodiment 80 of the head restraint. In addition, head restraint 120 includes a molded foam liner 124 formed from elastomeric urethane foam and having a preferred wall thickess of approximately ⅜ inches. Liner 124 includes a base 125, side and end wall portions 126, 128, a shallow spherical depression 130 for centering the back of the patient's head, and upstanding corner portions 132 where the side and end wall portions merge, all of which provide a cradling effect for holding the patient's head in place when straps 90', 92' are properly secured. As shown in FIG. 9, liner 124 fits snugly inside base 122 but can be easily removed for washing, cleaning or sterilization if necessary. Base 122 provides a stable, durable structure which can remain positioned on backboard 10 or 40 even while liner 124 is removed or replaced.

Figure 11:
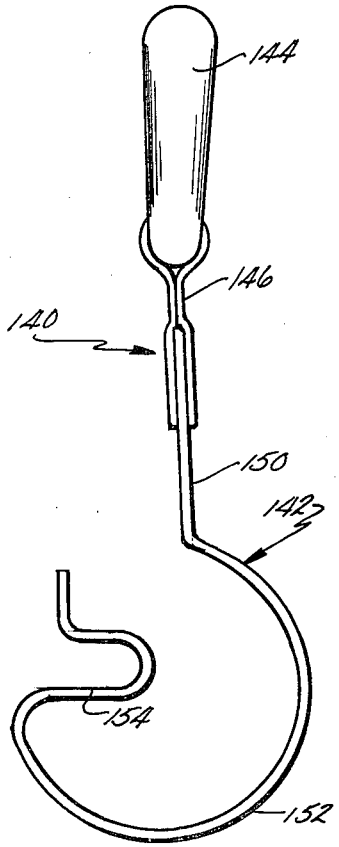
FIG. 11 is an end elevation of the carrying handle shown in FIG. 10.
Figure 10:
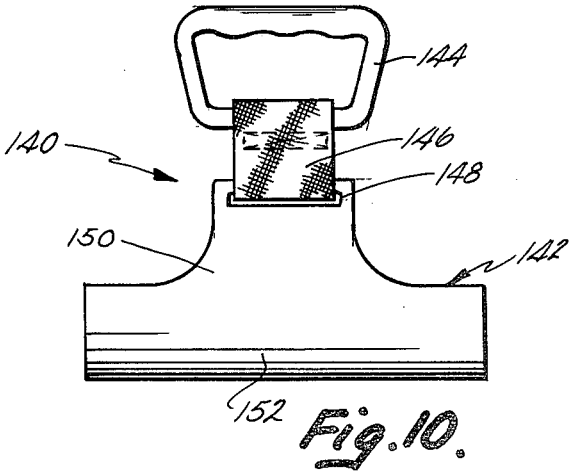
FIG. 10 is a side elevation of one of the supplemental carrying handles.

As shown in FIGS. 1, 2, 10 and 11, in addition to the peripheral flange structure providing a handhold and the through apertures 16, 28 which provide additional handholds, supplemental carrying handles 140 can be clipped to the edge structure to facilitate transportation of the backboard and patient. Each of the supplemental carrying handles 140 includes a securing clip member 142, a molded plastic or other closed-loop carrying handle 144, and a connecting length 146 of fabric webbing extending through handle 144, looped through aperture 148 in an extending flange 150 of securing clip member 142, and sewn to itself as shown in FIGS. 10 and 11. The main body of securing clip member 142 is a resilient, contoured, tempered aluminum or stainless steel member 152 having a cylindrical sectional shape or contour and an inwardly extending projection 154 substantially the same as that described above in connection with securing clip 54. Resilient body portion 152 may be expanded and fitted over the edge structure of backboard 10 or 40 in the same manner as securing clip 54 to position the carrying handles anywhere along the perhiphery of the backboard for supplemental carrying purposes. Inward protrusion 154 engages notch 36, 36' to prevent removal of the carrying handle from the edge structure in either form of the backboard unless it is properly expanded by pulling the protrusion outwardly against the resistance of the resilient body portion.

Accordingly, the present invention provides a composite backboard assembly for emergency medical treatment purposes which is strong, light in weight, substantially rigid and sufficiently durable to endure the rough handling and exposure in many different types of medical treatment situations. It can be combined with various accessories to immobilize the head, neck, other extremities, and indeed the entire patient being carried, and provides a convenient method for carrying the backboard and patient without incurring further injury to either the patient or rescuer.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow.

The embodiments of the invention in which an exclusive property or privilege is claimed are as follows:

1. A patient supporting and transporting backboard comprising a pair of cooperating, substantially rigid panels forming a rigid backboard unit, one panel being the top panel and adapted to carry a patient, the other panel being a bottom panel which engages, supports and rigidifies the top panel; said top panel being substantially coextensive and engaged with said bottom panel such that said top panel overlies said bottom panel, each panel being substantially rigid and molded from a resinous plastic material and including peripheral flange means secured to one another around the periphery of said unit and providing a peripheral handhold around the backboard; said bottom panel peripheral flange means being nested within and secured to said top panel peripheral flange means; means for securing said panels together to form said rigid backboard unit; and rib means in at least one of said panels for reinforcing, stabilizing and rigidifying the other of said panels when said panels are combined as said backboard unit.

2. The backboard of claim 1 wherein said means for securing said panels together include strip means extending along said flange means for attaching said top panel flange means to said bottom panel flange means.

3. The backboard of claim 2 wherein said strip means include a contoured, generally cylindrical strip fitted around said flange means and having means for receiving said combined flange means therewithin and providing a rounded handhold at said edges of said flange means.

4. The backboard of claim 3 wherein said flange means are parallel to one another, are flared outwardly to facilitate grasping, and are substantially coterminous with one another.

5. The backboard of claim 2 including head restraint means removably secured to said backboard adjacent one end thereof for positioning and substantially immobilizing the head of a patient when supported on said backboard; said head restraint means including a contoured head receptacle, first strap means for securing the head of a patient therein, and second strap means secured around said flange means for positioning said head restraint means on said top panel of said backboard.

6. The backboard of claim 5 wherein said head receptacle includes a generally rectangular base having a cranial depression therein and upwardly and outwardly extending side and end portions for cradling the patient's head.

7. The backboard of claim 6 wherein said first strap means are secured to said upstanding side portions adjacent either end of said head receptacle for engagement with forehead and chin areas of the head of a patient when a patient's head is received in said head restraint means; one end of said first strap means being permanently secured to one upstanding side and the other end having fastening means for securing said other end to the opposite upstanding side.

8. The backboard of claim 7 wherein said first strap means include a forehead engaging strap and a chin engaging strap, said straps being secured to said upstanding sides at a converging angle to the receptacle and one another whereby, when secured across a patient's forehead and chin, restraining force will be exerted by said straps on the patient's head inwardly toward said cranial depression in said base.

9. The backboard of claim 6 wherein said head receptacle is formed from a flexible, resilient, resinous plastic foam material; at least portions of said first and second strap means being embedded and secured within said material.

10. The backboard of claim 6 wherein said head receptacle is formed from a substantially rigid, resinous plastic material; at least portions of said first and second strap means being embedded and secured within said material; said head restraint means further including an interior liner, said liner being formed from a flexible, resilient, resinous plastic foam material and contoured to the interior shape of said head receptacle and having a base and upwardly and outwardly extending sides and ends providing a cranial depression for cradling the head of a patient.

11. The backboard of claim 5 wherein said backboard includes lateral side areas; said second strap means including a transverse strap affixed to said head receptacle and extending across said backboard and secured around said flange means at opposing portions of said lateral sides, and at least one longitudinal strap affixed to said head receptacle and extending to said one end of said backboard; said transverse and longitudinal straps including adjustment means for adjusting the length thereof and positioning said head receptacle on said backboard.

12. The backboard of claim 11 wherein said combined flange means and strip means together comprise a contoured, generally cylindrical shape, at least one of said flange means and strip means including a notch extending therealong; said transverse and longitudinal straps each including a securing clip having a contour corresponding to that of said combined flange and strip means, said securing clip formed from resilient material to allow expansion over and seating on said combined flange and strip means and having an inwardly extending projection thereon engaging said notch for retention of said clip on said combined flange and strip means.

13. The backboard of claim 1 or claim 2 wherein said means for securing said panels include an adhesive material intermediate said panels at selected positions.

14. The backboard of claim 1 wherein said top panel includes a substantially planar patient carrying section; said rib means including a plurality of ribs molded in said bottom panel between substantially planar sections to stiffen and stabilize said backboard; said bottom panel planar sections engaging and being adhered to the underside of said planar section of said top panel.

15. The backboard of claim 14 wherein said ribs include a pair of longitudinally extending, downwardly protruding channels opening into the interior of said backboard, the bottoms of said channels being coterminous for supporting said backboard on a surface and being spaced from said top panel and said peripheral flange means such that said periphery of said unit is spaced above any supporting surface to provide space for grasping and lifting said unit by said peripheral handhold.

16. The backboard of claim 15 wherein said ribs further include a plurality of cross-channels extending from side-to-side at spaced positions along the length of said bottom panel and intersecting said longitudinally extending channels, said cross-channels also opening into the interior of said backboard.

17. The backboard of claim 1 or claim 2 including a plurality of handhold openings extending through said top and bottom panels immediately adjacent said flange means.

18. The backboard of claim 1 or claim 2 including at least one tie-down strap means extending from side-to-side transversely across said backboard for securing a patient on said backboard; said tie-down strap means including resilient clip means at each end for removable attachment to said combined panel flange means at the sides of said backboard, an elongated, flexible strap, and strap length adjustment means for adjusting the strap length as desired.

19. A patient supporting and transporting backboard comprising a pair of cooperating, substantially rigid panels, one panel being the top panel and adapted to carry a patient, the other panel being a bottom panel which engages, supports and rigidifies the top panel; each panel being molded from a resinous plastic material and including downturned, peripheral flange means for securing said panels together and forming a peripheral handhold around the backboard; said bottom panel peripheral flange means being nested within and secured to said top panel peripheral flange means; and means for securing said panels together to form a rigid backboard unit; said means for securing said panels together including strip means extending along said flange means for attaching said top panel flange means to said bottom panel flange means; said strip means including a contoured, generally cylindrical strip fitted around said flange means and having means for receiving said combined flange means therewithin and providing a rounded handhold at said edges of said flange means; said flange means being parallel to one another, being flared outwardly to facilitate grasping, and being substantially coterminous with one another; said contoured strip being extruded from resinous plastic material and including a notch extending therealong on one side of said combined flanges providing a fingerhold and/or securing area for carrying handles or strap securing members.

20. A patient supporting and transporting backboard comprising a pair of cooperating, substantially rigid panels, one panel being the top panel and adapted to carry a patient, the other panel being a bottom panel which engages, supports and rigidifies the top panel; each panel being molded from a resinous plastic material and including downturned, peripheral flange means for securing said panels together and forming a peripheral handhold around the backboard; said bottom panel peripheral flange means being nested within and secured to said top panel peripheral flange means; and means for securing said panels together to form a rigid backboard unit; said means for securing said panels together including strip means extending along said flange means for attaching said top panel flange means to said bottom panel flange means; said flange means being respectively each flared outwardly and contoured to form a hollow bulbous, rounded, dowwardly extending flange when secured to one another, said flange means including edges which are aligned with one another.

21. The backboard of claim 20 wherein said strip means is an extruded member having opposing slots for receiving said edges of said flange means and sealing off the interior of said bulbous flange; said bottom panel flange means including a notch extending along one surface thereof providing a fingerhold and/or securing area for carrying handles or strap securing members.

22. A patient supporting and transporting backboard comprising a pair of cooperating, substantially rigid panels, one panel being the top panel and adapted to carry a patient, the other panel being a bottom panel which engages, supports and rigidifies the top panel; each panel being molded from a resinous plastic material and including downturned, peripheral flange means for securing said panels together and forming a peripheral handhold around the backboard; said bottom panel peripheral flange means being nested within and secured to said top panel peripheral flange means; and means for securing said panels together to form a rigid background unit; said means for securing said panels together including strip means extending along said flange means for attaching said top panel flange means to said bottom panel flange means; at least one of said flange means and strip means including a notch extending therealong providing a fingerhold and/or securing area for carrying handles or strap securing members.

23. The backboard of claim 19 or claim 22 including at least one carrying handle removably secured around said combined flange and strip means, said handle including a handle member, a resilient securing clip, and means for securing said handle member to said clip; said securing clip having a resilient body having a cross-sectional shape corresponding to that of said combined flange and strip means, said body allowing expansion over and seating on said combined flange and strip means and having an inwardly extending projection thereon engaging said notch for retention of said clip on said combined flange and strip means.

24. A patient supporting and transporting backboard assembly comprising first and second substantially rigid, cooperating panel means for engagement with one another to form a backboard unit, said panel means being substantially coextensive and engaged with one another such that said first panel means overlies said second panel means, said panel means being formed from lightweight, corrosive resistant, substantially rigid material and including peripheral flange means secured to one another around the periphery thereof to form said unit and a hollow, bulbous, downwardly extending area adjacent to and extending around said periphery of said backboard unit for providing a peripheral handhold and securing edge said peripheral flange means also including means for receiving and removably attaching securing clip members on tie-down straps, carrying handles and/or head restraints anywhere therealong; and rib means in at least one of said panel means for reinforcing, stabilizing and rigidifying the other of said panel means when said panel means are combined as said backboard unit.

25. The backboard assembly of claim 24 including head restraint means removably secured to said backboard adjacent one end thereof for positioning and substantially immobilizing the head of a patient when supported on said backboard; said head restraint means including a contoured head receptacle, first strap means for securing the head of a patient therein, and second strap means secured around said peripheral flange means for positioning said head restraint means on said top panel of said backboard.

26. The backboard assembly of claim 25 including at least one tie-down strap means extending from side-to-side transversely across said backboard for securing a patient on said backboard; said tie-down strap means including resilient clip means at each end for removable attachment to said peripheral panel flange means at the sides of said backboard, an elongated, flexible strap, and strap length adjustment means for adjusting the strap length as desired.

27. The backboard assembly of claim 26 including at least one carrying handle removably secured around said peripheral flange means, said handle including a handle member, a resilient securing clip, and means for securing said handle member to said clip; said securing clip having a resilient body with a cross-sectional shape corresponding to that of said peripheral flange means, said body allowing expansion over and seating on said peripheral flange means.

28. The backboard assembly of claim 24 or claim 27 wherein said one panel means is a bottom panel formed from resinous plastic material, the other panel being a top panel also formed from resinous plastic material; said top panel including a substantially planar patient carrying section; said bottom panel including said rib means which comprise a plurality of ribs molded therein between substantially planar sections to stiffen and stabilize said backboard; said bottom panel planar sections engaging and being adhered to the underside of said planar section of said top panel.

29. The backboard assembly of claim 28 wherein said ribs include a pair of longitudinally extending, downwardly protruding channels opening into the interior of said backboard, the bottoms of said channels being coterminous for supporting said backboard on a surface and being spaced from said top panel and said hollow, bulbous edge area such that said periphery of said unit including said edge area is spaced above any supporting surface to provide space for grasping and lifting said unit by said peripheral handhold and securing edge; a plurality of cross-channels extending from side-to-side at spaced positions along the length of said bottom panel and intersecting said longitudinally extending channels, said cross-channels also opening into the interior of said backboard.

30. The backboard assembly of claim 24 or claim 27 including a plurality of handhold openings extending through said top and bottom panels immediately adjacent said flange means.

31. A patient supporting and transporting backboard assembly comprising first and second substantially rigid, cooperating panel means for engagement with one another to form a backboard unit, said panel means engaged with one another and formed from lightweight, corrosive resistant, substantially rigid material and including downturned, peripheral flange means secured to one another for providing a peripheral handhold and securing edge, and rib means in at least one of said panel means for reinforcing, stabilizing and rigidifying the other of said panel means; said peripheral flange means including means for receiving and removably attaching securing clip members on tie-down straps, carrying handles and/or head restraints anywhere therealong; said means for receiving and removably attaching securing clip members including strip means extending along said flange means for securing said flange means to one another; said combined flange and strip means having an outwardly curved bulbous shape providing a comfortable handhold; at least one of said flange and strip means including a notch extending therealong for receiving a protrusion from a securing clip on a carrying handle, tie-down strap and/or head restraint for retention thereof.

32. The backboard assembly of claim 31 including securing clip means received on said combined flange and strip means for securing a carrying handle, tie-down strap, or head restraint on said combined flange and strip means, said securing clip having a contour corresponding to that of said combined flange and strip means and formed from resilient material to allow expansion over and seating on said combined flange and strip means, said clip also including an inwardly extending projection thereon engaging said notch for retention of said clip on said combined flange and strip means.

* * * * *

UNITED STATES PATENT AND TRADEMARK OFFICE

CERTIFICATE OF CORRECTION

PATENT NO. : 4,473,912

DATED : October 2, 1984

INVENTOR(S) : Edward J. Scheidel and Lawrence K. Buckenmeyer

It is certified that error appears in the above-identified patent and that said Letters Patent is hereby corrected as shown below:

Column 2, lines 20 and 21:

"downturned," should be deleted

Column 2, line 23:

After "backboard." delete "The" and insert --In one form, the--

Column 2, line 25:

After "flange." insert --In another form, a hollow, bulbous, downwardly extending area is provided adjacent to the periphery to provide a peripheral handhold and securing edge.--

Column 2, line 30:

Delete ", as well as an" and insert --. An--

UNITED STATES PATENT AND TRADEMARK OFFICE

CERTIFICATE OF CORRECTION

PATENT NO. : 4,473,912

DATED : October 2, 1984

INVENTOR(S) : Edward J. Scheidel and Lawrence K. Buckenmeyer

It is certified that error appears in the above-identified patent and that said Letters Patent is hereby corrected as shown below:

Column 2, line 32:

After "flange" insert --may also be used--

Column 4, line 30:

"80 of 120" should be --80 or 120--

Column 7, lines 34 and 35:

"protrusions 57" should be --protrusion 57--

Column 7, line 65:

"area" should be --areas--

Column 9, line 53:

"perhiphery" should be --periphery--

Column 10, line 45:

Delete "2" and insert --1--

UNITED STATES PATENT AND TRADEMARK OFFICE

CERTIFICATE OF CORRECTION

PATENT NO. : 4,473,912

DATED : October 2, 1984

INVENTOR(S) : Edward J. Scheidel and Lawrence K. Buckenmeyer

It is certified that error appears in the above-identified patent and that said Letters Patent is hereby corrected as shown below:

Column 11, line 36:

After "wherein" insert --said means for securing said panels together include strip means extending along said flange means for attaching said top panel flange means to said bottom panel flange means;--

Column 11, line 37:

"comprise" should be --comprising--

Column 13, line 20:

"background" should be --backboard--

Column 13, line 52:

After "edge" insert --;--

UNITED STATES PATENT AND TRADEMARK OFFICE

CERTIFICATE OF CORRECTION

PATENT NO. : 4,473,912

DATED : October 2, 1984

INVENTOR(S) : Edward J. Scheidel and Lawrence K. Buckenmeyer

It is certified that error appears in the above-identified patent and that said Letters Patent is hereby corrected as shown below:

Column 14, line 3:

After "of" insert --claim 24 or--

Column 14, line 12:

After "of" insert --claim 24 or--

Signed and Sealed this

*Twenty-third* Day of *April 1985*

[SEAL]

*Attest:*

DONALD J. QUIGG

*Attesting Officer* *Acting Commissioner of Patents and Trademarks*